US006648768B1

(12) United States Patent
Tseng

(10) Patent No.: US 6,648,768 B1
(45) Date of Patent: Nov. 18, 2003

(54) SWING ASSEMBLY WITH A SEAT BACK ADJUSTABLE BETWEEN A HORIZONTAL POSITION AND AN INCLINED POSITION

(75) Inventor: Chuen-Jong Tseng, Chiayi Hsien (TW)

(73) Assignee: Shin Yeh Enterprise Co., Ltd., Chiaya Hsien (TW)

( * ) Notice: Subject to any disclaimer, the term of this patent is extended or adjusted under 35 U.S.C. 154(b) by 0 days.

(21) Appl. No.: 10/375,838

(22) Filed: Feb. 26, 2003

(51) Int. Cl.[7] ..... A63G 9/00

(52) U.S. Cl. ..... 472/118; 472/125; 297/354.13; 5/37.1

(58) Field of Search ..... 472/118, 120, 472/121, 122, 123, 124, 125; 297/273, 354.12, 354.13, 374; 5/37.1, 43

(56) References Cited

U.S. PATENT DOCUMENTS 1,214,854 A * 2/1917 Weil ..... 472/124
3,161,893 A * 12/1964 Siler ..... 5/120
4,131,960 A * 1/1979 Quakenbush ..... 5/37.1
5,103,510 A * 4/1992 Thurow ..... 5/37.1
5,271,109 A * 12/1993 Markel et al. ..... 5/37.1
5,957,780 A * 9/1999 Grazioli ..... 472/118
6,135,559 A * 10/2000 Kowalski ..... 297/354.12
6,209,154 B1 * 4/2001 Huang ..... 5/37.1
6,348,005 B1 * 2/2002 Tseng ..... 472/118

* cited by examiner

*Primary Examiner*—Kien T. Nguyen
(74) *Attorney, Agent, or Firm*—Ladas & Parry

(57) ABSTRACT

A swing assembly includes a swing frame unit disposed swingably on a support unit, and a seat unit connected to the swing frame unit by means of a pair of left and right linkage units. The seat unit includes a seat and a back that is rotatable relative to the swing frame unit between a horizontal position and an inclined position when the seat is disposed at a horizontal position.

10 Claims, 7 Drawing Sheets

SWING ASSEMBLY WITH A SEAT BACK ADJUSTABLE BETWEEN A HORIZONTAL POSITION AND AN INCLINED POSITION

BACKGROUND OF THE INVENTION

1. Field of the Invention

This invention relates to a swing, more particularly to a swing assembly that has a seat back, which is adjustable between a horizontal position and an inclined position.

2. Description of the Related Art

Referring to FIG. 1, a conventional swing assembly 1 is shown to include a support unit 11, a pair of left and right hanging units 12, and a swingable seat unit 13. The support unit 11 includes a pair of left and right leg frames 111, a horizontal support rod 112 having two ends that are connected respectively and fixedly to top ends of the left and right leg frames 111, and two inclined hanging plates 113, each of which is connected fixedly to the horizontal support rod 112 and a respective one of the left and right leg frames 111. Each of the hanging units 12 includes a resilient member 121 fastened to the corresponding hanging plate 113, and two hanging rods 122 having top ends fastened to the resilient member 121. The seat unit 13 includes a pair of left and right armrest members 131, a seat portion 132 fixed between the left and right armrest members 131, and a back portion 133 fixed on a rear side of the seat portion 132 so that a user cannot lie substantially flat on the seat portion 132. Furthermore, the seat unit 13 is swingable, and is not fixed relative to the ground, thereby resulting in limited use of the conventional swing assembly 1.

SUMMARY OF THE INVENTION

An object of this invention is to provide a swing assembly, which includes a seat back that is adjustable between a horizontal position, where the user can lie substantially flat on the swing assembly, and an inclined position, where the user can sit on the swing assembly.

Another object of this invention is to provide a swing assembly, which includes a swingable seat unit and a seat-positioning unit that is operable to prevent swinging movement of the seat unit relative to a support unit.

According to this invention, a swing assembly includes a swing frame unit disposed swingably on a support unit, and a seat unit connected to the swing frame unit by means of a pair of left and right linkage units. The seat unit includes a seat and a back that is rotatable relative to the swing frame unit between a horizontal position and an inclined position when the seat is disposed at a horizontal position.

Preferably, a seat-positioning unit is disposed between the swing frame unit and the support unit, and is operable to fix the swing frame unit relative to the support unit.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
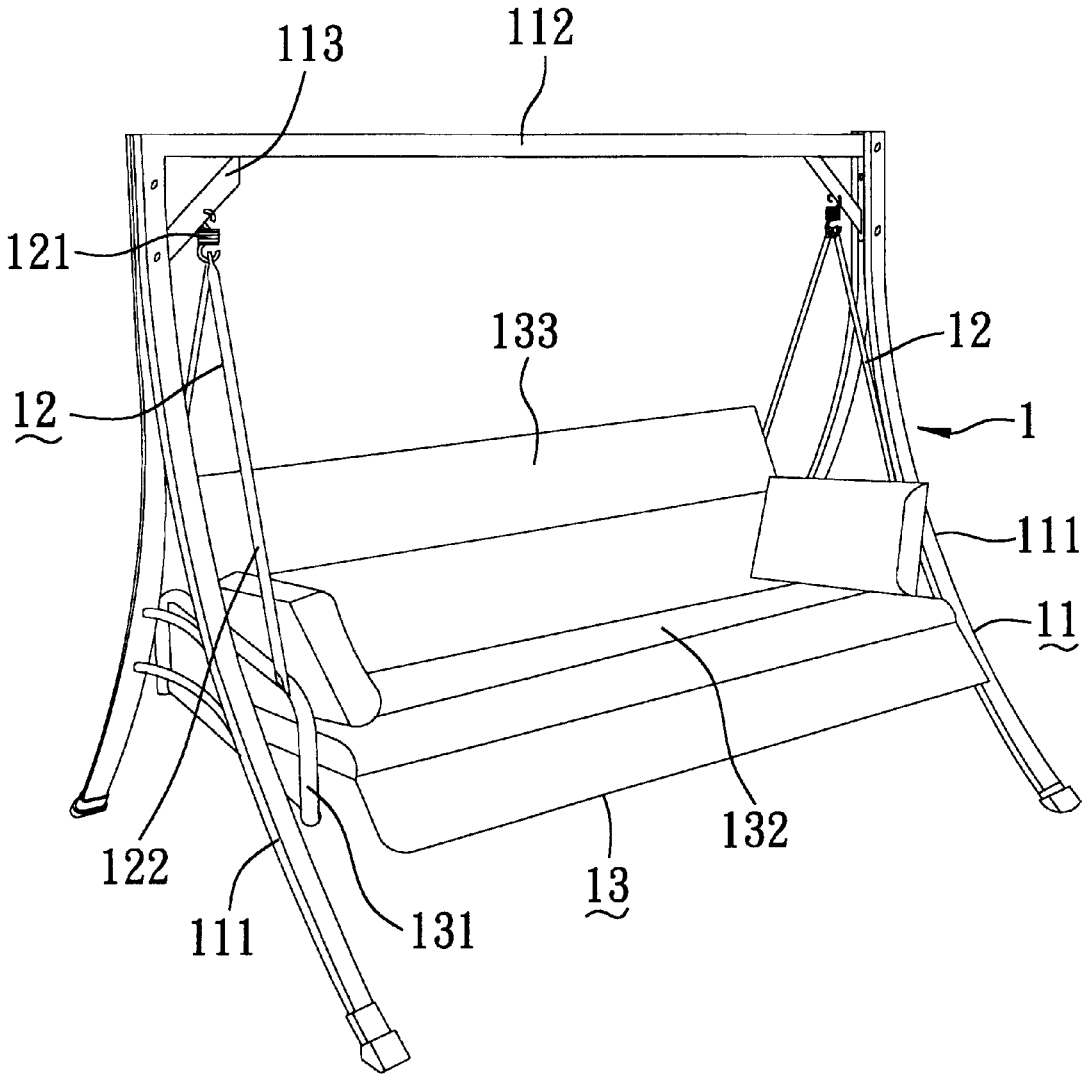
FIG. 1 PRIOR ART
FIG. 1 is a perspective view of a conventional swing assembly.
Figure 2:
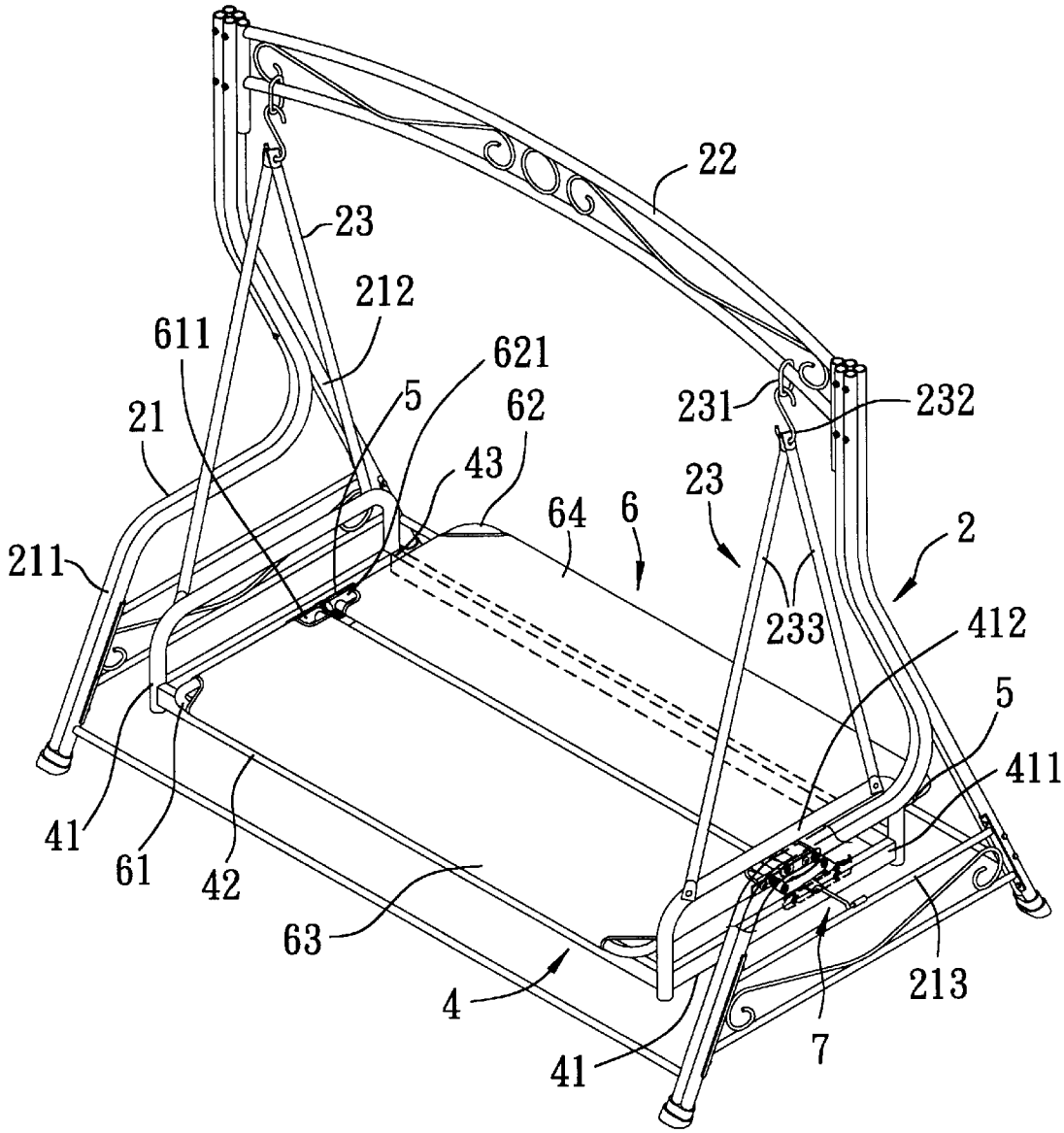
FIG. 2 is a perspective view of the preferred embodiment of a swing assembly according to this invention.
Figure 3:
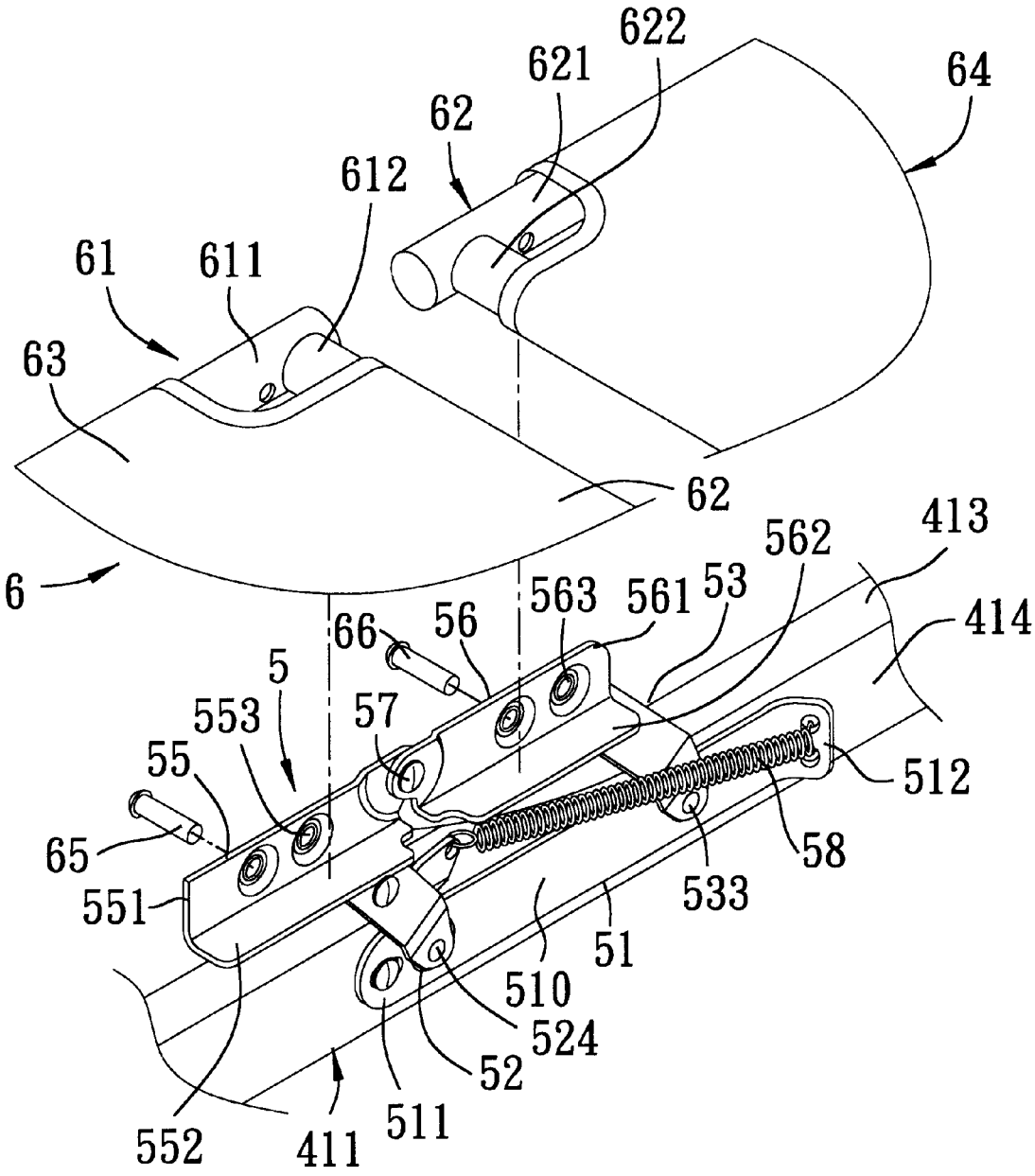
FIG. 3 is a partly exploded, fragmentary perspective view of the preferred embodiment, illustrating how a seat unit is connected to a swing frame unit by means of a pair of linkage units.

Referring to FIGS. 2 and 3, the preferred embodiment of a swing assembly according to this invention is shown to include a support unit 2, a swing frame unit 4, a pair of left and right linkage units 5, a seat unit 6, and a seat-positioning unit 7.

The support unit 2 includes a pair of left and right leg frames 21, a horizontal support rod 22 having two ends that are connected respectively and fixedly to top ends of the left and right leg frames 21, and a pair of left and right hanging assemblies 23 suspended respectively from two end portions of the horizontal support rod 22. Each of the left and right leg frames 21 has a front leg rod 211, a rear leg rod 212 disposed behind the front leg rod 211, and a connecting rod 213 that has a front end connected fixedly to the front leg rod 211, and a rear end connected fixedly to the rear leg rod 212. Each of the hanging assemblies 23 includes a retaining ring 231 that is sleeved fixedly around the horizontal support rod 22, an S-shaped hook 232 hooked on the retaining ring 231, and two hanging rods 233 having top ends hung on the hook 232.

The swing frame unit 4 is disposed on the support unit 2, and includes a pair of spaced-apart left and right side frames 41, and a pair of spaced-apart front and rear abutment rods 42, 43 disposed between and interconnecting fixedly the left and right side frames 41. Each of the left and right side frames 41 has a tubular horizontal side rod 411 (see FIGS. 2 and 3), and a tubular armrest rod 412 connected fixedly to the side rod 411. Each of the side rods 411 has a horizontal top surface 413 and a vertical mounting surface 414.

Figure 4:
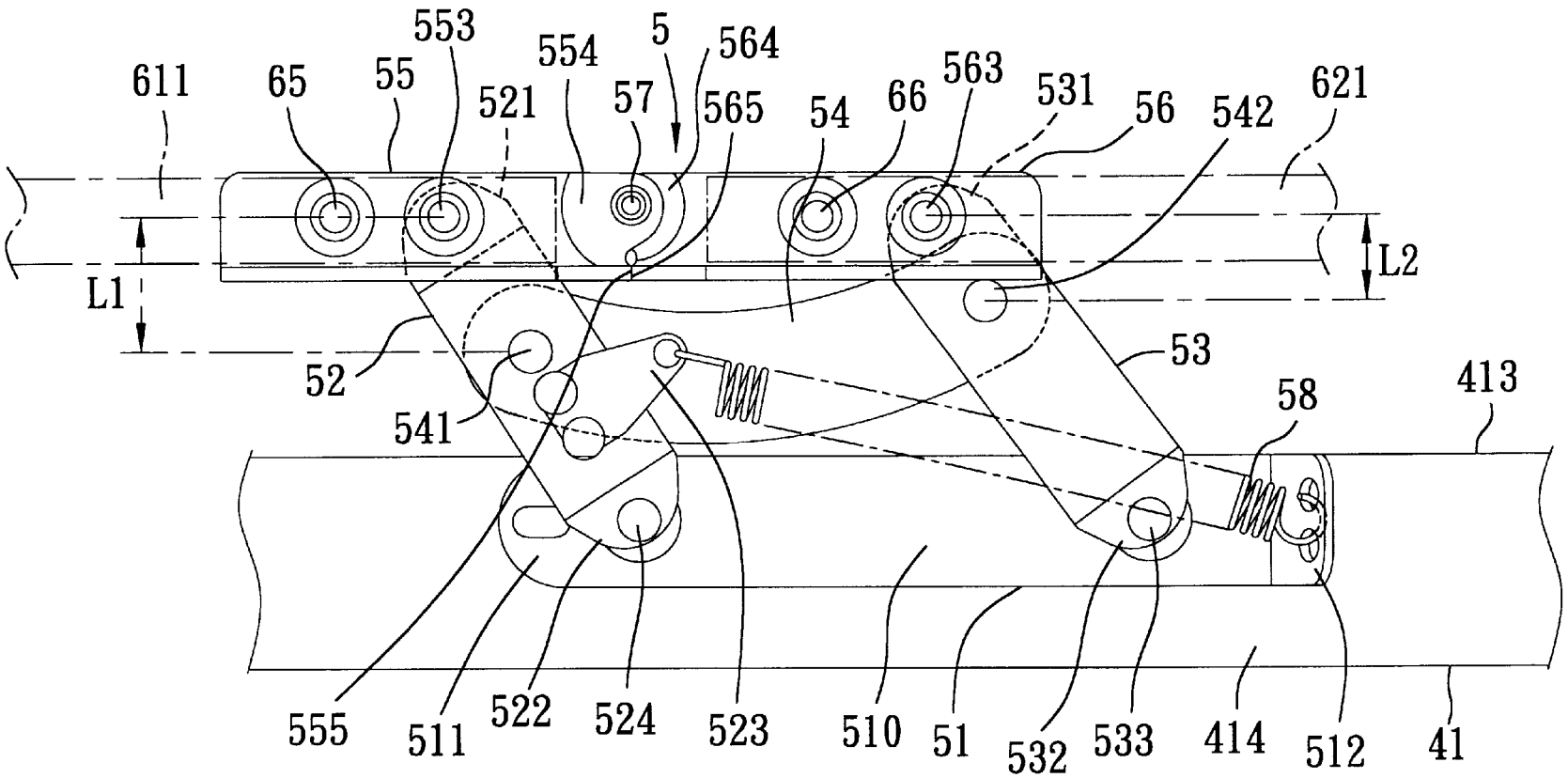
FIG. 4 illustrates a horizontal position of a seat back of the preferred embodiment relative to the swing frame unit when the swing frame is fixed relative to a support unit.

Referring to FIG. 4, the left and right linkage units 5 are disposed respectively on the left and right side frames 41. Each of the left and right linkage units 5 has a fixing piece 51, a front link 52, a rear link 53, a curved intermediate link 54, a seat-coupling piece 55, a back-coupling piece 56, a horizontal pin 57, and a coiled tension spring 58. Only one of the left and right linkage units 5 will be described in the succeeding paragraph.

Figure 6:
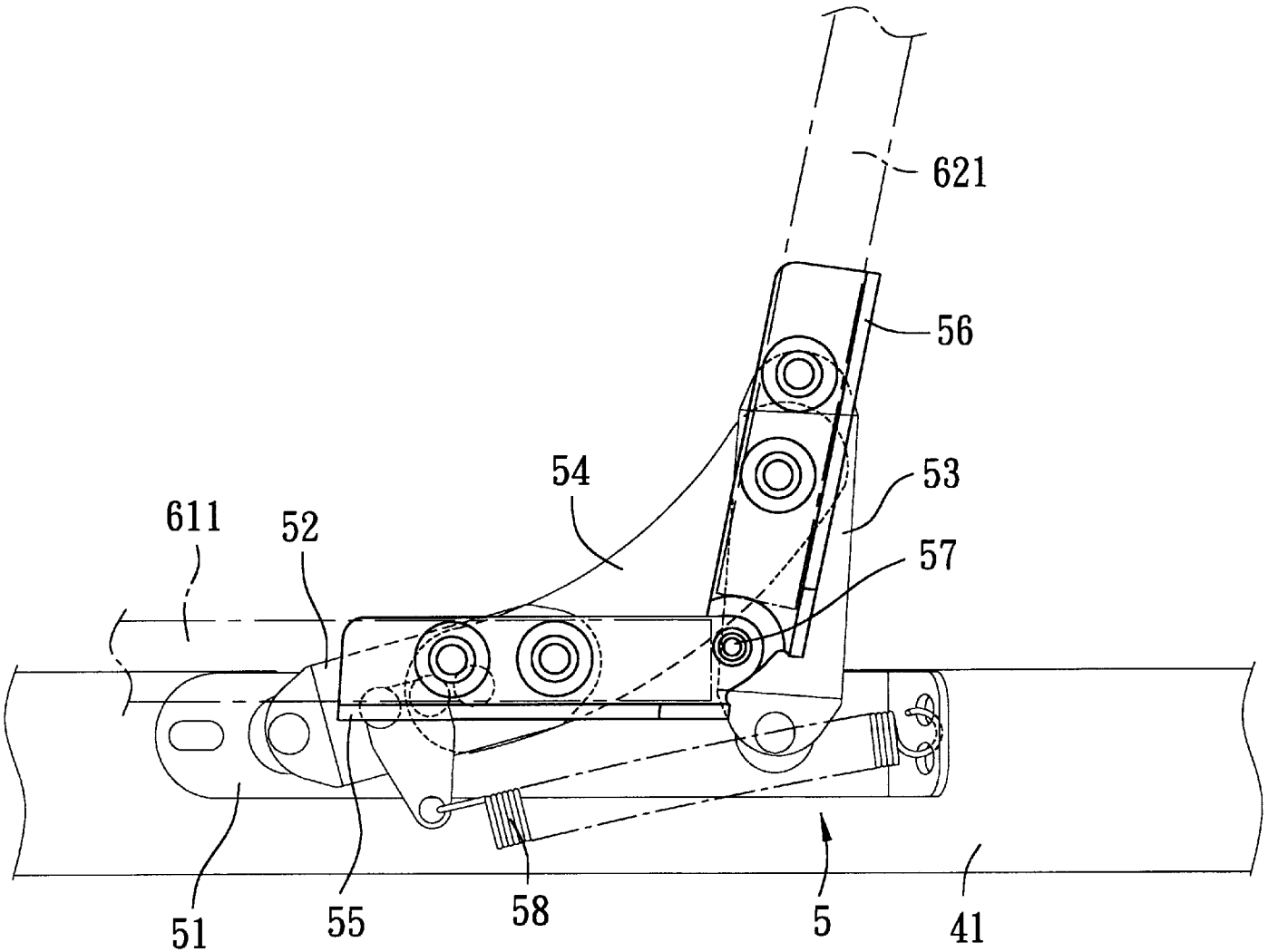
FIG. 6 illustrates how the seat back of the preferred embodiment is adjusted from the horizontal position to an inclined position when the swing frame unit is fixed relative to the support unit.

The fixing piece 51 has an intermediate plate portion 510 mounted respectively and fixedly on the mounting surfaces 414 of the side rods 411 of the left and right side frames 41. The front link 52 has a first end 521 and a second end 522 that is connected pivotally to a front end plate portion 511 of the fixing piece 51 by a front lower pivot 524. The rear link 53 has a first end 531 and a second end 532 that is connected pivotally to a bent rear end plate portion 512 of the fixing piece 51 by a rear lower pivot 533, which is disposed at a level the same as that of the front lower pivot 524, as shown in FIG. 4. The rear end plate portion 512 extends integrally and inwardly from a rear end of the intermediate plate portion 510. The intermediate link 54 has a front end connected pivotally to the front link 52 at a position between the first and second ends 521, 522 of the front link 52 by a front intermediate pivot 541, and a rear end connected pivotally to the rear link 53 at a position between the first and second ends 531, 532 of the rear link 53 by a rear intermediate pivot 542. The seat-coupling piece 55 is connected pivotally to the first end 521 of the front link 52 by a front upper pivot 553. The back-coupling piece 56 is connected pivotally to the first end 531 of the rear link 53 by a rear upper pivot 563. The rear upper pivot 563 is spaced apart from the rear intermediate pivot 542 by a distance (L2) that is greater than a distance (L1) between the front upper pivot 553 and the front intermediate pivot 541. The rear upper pivot 563 is spaced apart from the rear lower pivot 533 by a distance equal to that between the front upper pivot 553 and the front lower pivot 524. Each of the seat-coupling piece 55 and the back-coupling piece 56 has an L-shaped cross-section, and includes a vertical wall 551, 561 and a horizontal wall 552, 562 extending integrally and inwardly from a bottom side of the vertical wall 551, 561. The vertical wall 551 of the seat-coupling piece 55 has a pressed rear end 554 that is connected rotatably to a pressed front end 564 of the back-coupling piece 56 by the pin 57, and an integral limiting projection 555 that is formed on a rear end of the vertical wall 551. The back-coupling piece 56 is formed with an integral limiting projection 565 at a front end of the vertical wall 561. When the swing frame unit 4 is fixed relative to the support unit 2, the back-coupling piece 56 is rotatable relative to the seat-coupling piece 55 between a horizontal position shown in FIG. 4, where the limiting projections 555, 565 abut against each other and are located under the pin 57 to prevent the same from turning downwardly toward each other and where the front and rear links 52, 53 are parallel to each other, and an inclined position shown in FIG. 6, where the limiting projections 555, 565 are spaced apart from each other. The tension spring 58 has two ends that are fastened respectively to the rear end plate portion 512 of the fixing piece 51 and a spring-connecting plate 523 that is connected fixedly to an intermediate portion of the front link 52. As such, the first end 521 of the front link 52 is biased by the tension spring 58 to turn rearwardly.

The seat unit 6 includes a seat consisting of an annular seat frame 61 and a seat cushion 63 sleeved around the seat frame 61, and a back consisting of a back frame 62 and a back cushion 64 sleeved around the back frame 62. The seat frame 61 is connected fixedly to the seat-coupling pieces 55 by first fasteners 65, and has a front side that abuts against the front abutment rod 42 of the swing frame unit 4. The back frame 62 is connected fixedly to the back-coupling pieces 56 by second fasteners 66, and has a front side that is adjacent to a rear side of the seat frame 61, and a rear side that is rotatable about the front side of the back frame 62. As such, when the swing frame unit 4 is fixed relative to the support unit 2 so that the seat of the seat unit 6 is horizontal, the back is rotatable between a horizontal position shown in FIG. 4, where the rear side of the back frame 62 abuts against the rear abutment rod 43 of the swing frame unit 4 and where the tension springs 58 are at stretched states, and an inclined position shown in FIG. 6, where the seat and the back cushions 63, 64 define an angle therebetween, which is between 90° and 180° and which is preferably slightly greater than 90°, and where the tension springs 58 are at relaxed states. Each of the seat and back frames 61, 62 has a pair of left and right side rod portions 611, 621 connecting respectively and fixedly to the corresponding vertical walls 551, 561 of the seat-coupling pieces 55 and the back-coupling pieces 56 by the first and second fasteners 65, 66, and a pair of connecting rod portions 612, 622 that are disposed between and that interconnect fixedly the left and right side rod portions 611, 621. When the back is disposed at the horizontal position shown in FIG. 4, the left and right side rod portions 611, 621 of the seat and back frames 61, 62 are supported respectively on the horizontal walls 552, 562 of the seat-coupling pieces 55 and the back-coupling pieces 56.

The seat-positioning unit 7 is disposed operably between the swing frame unit 4 and the support unit 2, and is operable to prevent swinging movement of the swing frame unit 4 relative to the support unit 2.

Figure 5:
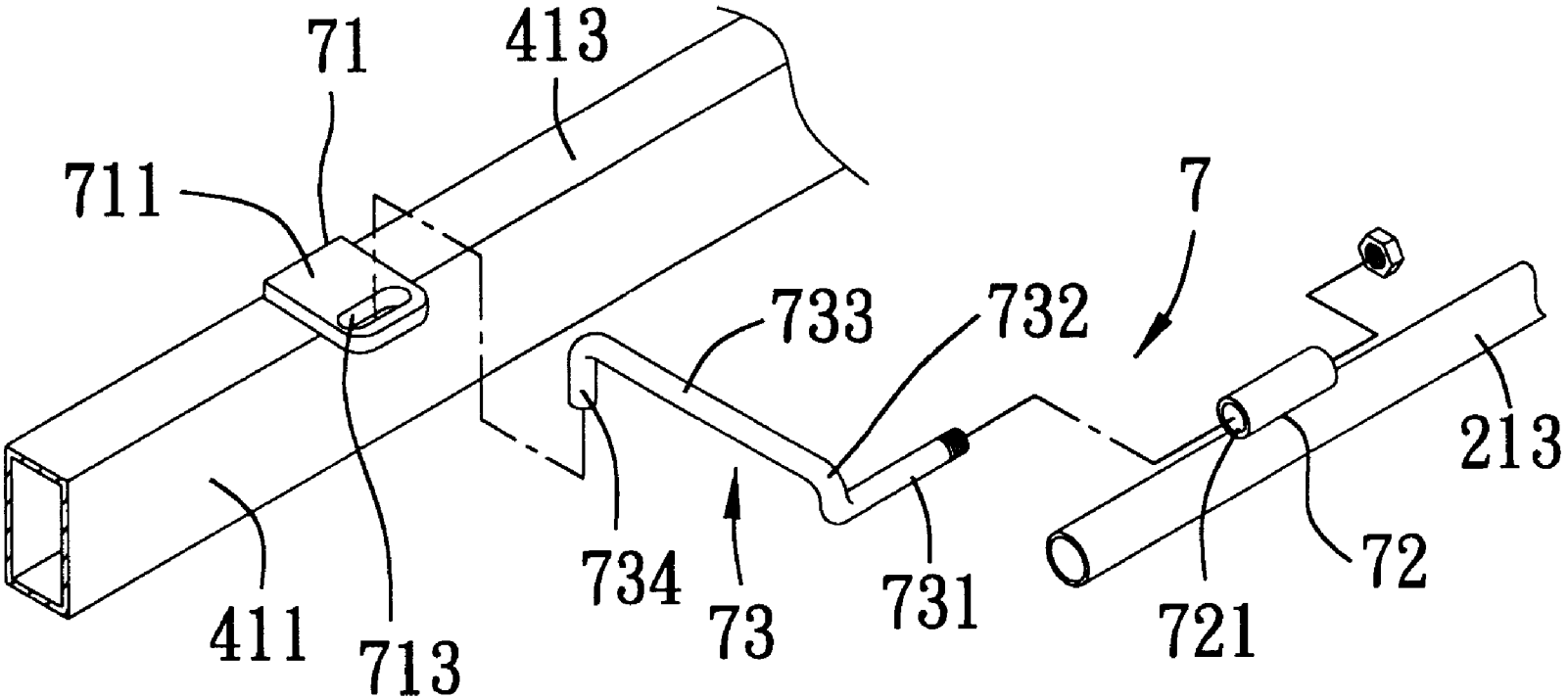
FIG. 5 is an exploded perspective view of a seat-positioning unit of the preferred embodiment.
Figure 7:
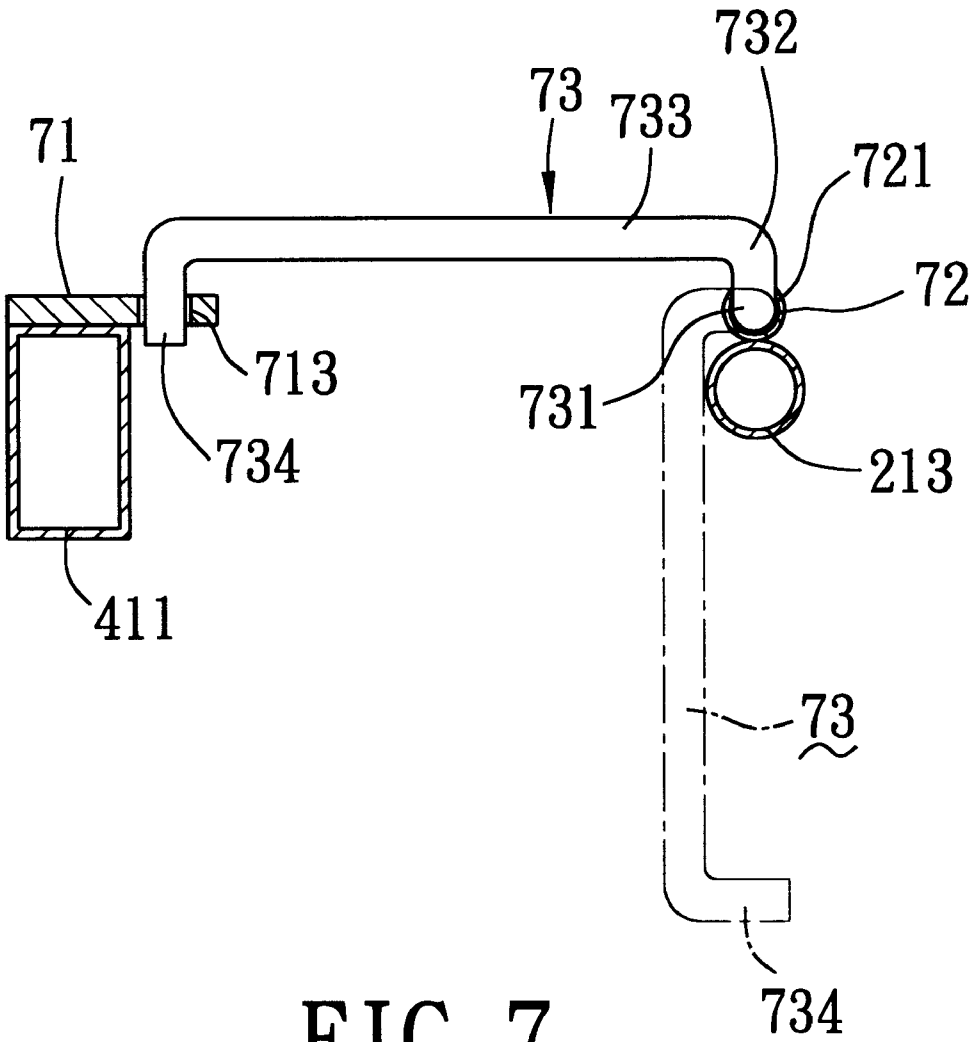
FIG. 7 illustrates how the swing frame unit of the preferred embodiment is fixed on the support unit by means of the seat-positioning unit.

Referring to FIGS. 2 and 5, the seat-positioning unit 7 includes a socket element 71, a sleeve 72, and an insert rod 73. The socket element 71 is disposed fixedly on the top surface 413 of one of the side rods 411 of the swing frame unit 4, and has a horizontal top surface 711 that is formed with a hole 713 therethrough. The sleeve 72 is disposed fixedly on one of the connecting rods 213 of the support unit 2. The insert rod 73 has a horizontal rotating shaft portion 731 that extends through a central hole 721 in the sleeve 72 and that is rotatable relative to the sleeve 72, a radial rod portion 732 extending radially from a front end of the rotating shaft portion 731, a connecting rod portion 733 extending perpendicularly from the radial rod portion 732, and an engagement rod portion 734 extending perpendicularly from the connecting rod portion 733. When the swing frame unit 4 is rotated relative to the support unit 2 to move the socket element 71 to a position adjacent to the sleeve 72, the insert rod 73 can be rotated so as to cause the engagement rod portion 734 of the insert rod 73 to engage the hole 713 in the socket element 71 such that the back of the seat unit 6 can be turned to the horizontal position shown in FIG. 4, thereby permitting 1 the user to lie substantially flat on the seat and back cushions 63, 64 of the seat unit 6. When the engagement rod portion 734 is turned upwardly to disengage from the socket element 71, the socket element 71 can be turned forwardly or rearwardly so as to be deflected from the engagement rod portion 734, thereby permitting the insert rod 73 to turn downwardly to an idle position shown in FIG. 7.

With this invention thus explained, it is apparent that numerous modifications and variations can be made without departing from the scope and spirit of this invention. It is therefore intended that this invention be limited only as indicated by the appended claims.

I claim:

1. A swing assembly comprising:

a support unit;

a swing frame unit disposed swingably on said support unit and including a pair of spaced-apart left and right side frames, and a pair of spaced-apart front and rear abutment rods disposed between and interconnecting fixedly said left and right side frames, said swing frame unit being turnable forwardly and rearwardly relative to said support unit;

a pair of left and right linkage units disposed respectively on said left and right side frames of said swing frame unit, each of said left and right linkage units including a fixing piece mounted fixedly on a corresponding one of said left and right side frames and having a front end and a rear end, a front link having a first end and a second end that is, connected pivotally to said front end of said fixing piece, a rear link having a first end and a second end that is connected pivotally to said rear end of said fixing piece, an intermediate link having a front end connected pivotally to said front link at a position between said first and second ends of said front link, and a rear end connected pivotally to said rear link at a position between said first and second ends of said rear link, a seat-coupling piece connected pivotally to said first end of said front link, a back-coupling piece connected pivotally to said first end of said rear link, and a coiled tension spring having two ends that are fastened respectively to said front link and said rear end of said fixing piece so as to bias said first end of said front link to turn rearwardly;

a seat unit including a seat that is connected fixedly to said seat-coupling piece and that has a rear side and a back that is connected fixedly to said back-coupling piece and that has a front side which is adjacent to said rear side of said seat, and a rear side which is rotatable about said front side of said back, said back being rotatable between a horizontal position, where said rear side of said back abuts against said rear abutment rod of said swing frame unit and where said tension springs of said left and right linkage units are at stretched states, and an inclined position, where said seat and said back define an angle of 90° to 180° therebetween and where said tension springs are at relaxed states.

2. The swing assembly as claimed in claim 1, wherein each of said left and right side frames includes a horizontal side rod, each of said fixing pieces of said left and right linkage units having an intermediate plate portion that is connected fixedly to a respective one of said side rods and that has a rear end, and a rear end plate portion that extends integrally and inwardly from said rear end of said intermediate plate portion, each of said front links of said left and right linkage units including a fixed spring-connecting plate that is disposed between said first and second ends of a respective one of said front links, said tension springs of said left and right linkage units being fastened to said spring-connecting plates of said front links and said rear end plate portions of said fixing pieces.

3. The swing assembly as claimed in claim 1, wherein said seat includes an annular seat frame and a seat cushion that is sleeved fixedly on said seat frame, and said back includes a back frame and a back cushion that is sleeved fixedly on said back frame, each of said seat frame and said back frame having a pair of left and right side rod portions, and a pair of connecting rod portions that are disposed between and that interconnect fixedly said left and right side rod portions.

4. The swing assembly as claimed in claim 3, wherein each of said seat-coupling pieces and said back-coupling pieces of said left and right linkage units includes:

a vertical wall having a front end, a rear end, and a bottom side, and a horizontal wall extending integrally and inwardly from said bottom side of said vertical wall and having a top surface for supporting a corresponding one of said left and right side rod portions of said seat frame and said back frame when said back is disposed at said horizontal position.

5. The swing assembly as claimed in claim 4, wherein said vertical walls of said seat-coupling pieces and said back-coupling pieces are connected respectively and fixedly to said left and right side rod portions of said seat frame and said back frame.

6. The swing assembly as claimed in claim 4, wherein each of said left and right linkage units further includes two horizontal pins that connect respectively and rotatably said rear ends of said vertical walls of said seat-coupling pieces to said front ends of said vertical walls of said back-coupling pieces.

7. The swing assembly as claimed in claim 6, wherein each of said rear ends of said vertical walls of said seat-coupling pieces and said front ends of said vertical walls of said back-coupling pieces is formed with an integral limiting projection, said limiting projections of said seat-coupling piece and said back-coupling piece of each of said left and right linkage units abutting against each other and being disposed under a corresponding one of said pins when said back is disposed at said horizontal position so as to prevent downward turning of said seat and said back toward each other.

8. The swing assembly as claimed in claim 1, wherein each of said left and right linkage units further includes:

a front upper pivot for connecting said front link rotatably to said seat-coupling piece;

a front intermediate pivot for connecting said front link rotatably to said intermediate link;

a front lower pivot for connecting said front link rotatably to said fixing piece;

a rear upper pivot for connecting said rear link rotatably to said back-coupling piece;

a rear intermediate pivot for connecting said rear link rotatably to said intermediate link, said rear intermediate pivot being spaced apart from said rear upper pivot by a distance greater than that between said front intermediate pivot and said front upper pivot; and a rear lower pivot for connecting said rear link rotatably to said fixing piece, said rear lower pivot being disposed at a level the same as that of said front lower pivot, said rear upper pivot being spaced apart from said rear lower pivot by a distance equal to that between said front upper pivot and said front lower pivot such that said front and rear links are parallel to each other when said back is disposed at said horizontal position.

9. The swing assembly as claimed in claim 1, further comprising a seat-positioning unit that is disposed operably between said swing frame unit and said support unit and that is operable to prevent swinging movement of said swing frame unit relative to said support unit.

10. The swing assembly as claimed in claim 9, wherein each of said left and right side frames of said swing frame unit includes a horizontal side rod, said support unit including a pair of left and right leg frames, each of which has a front leg rod, a rear leg rod disposed behind said front leg rod, and a connecting rod that has a front end connected fixedly to said front leg rod, and a rear end connected fixedly to said rear leg rod, said seat-positioning unit including:

a socket element disposed fixedly on one of said side rods of said swing frame unit and having a top surface that is formed with a hole;

a sleeve disposed fixedly on one of said connecting rods of said left and right leg frames; and an insert rod extending through and being rotatable relative to said sleeve, said insert rod having an engagement rod portion that is rotatable to engage said hole in said socket element when said swing frame unit is rotated relative to said support unit to move said socket element to a position adjacent to said sleeve.

* * * * *